United States Patent [19]

Cannon

[11] Patent Number: 4,796,695

[45] Date of Patent: Jan. 10, 1989

[54] TUBE SUPPORTS

[75] Inventor: Kenneth A. Cannon, Bartlesville, Okla.

[73] Assignee: Phillips Petroleum Company, Bartlesville, Okla.

[21] Appl. No.: 509,542

[22] Filed: Jun. 30, 1983

[51] Int. Cl.[4] ..... F28F 9/23; F28F 9/00

[52] U.S. Cl. ..... 165/159; 165/160; 165/162

[58] Field of Search ..... 165/162, 159, 160, 172, 165/69, 109

[56] References Cited

U.S. PATENT DOCUMENTS

| | | | |
|---|---|---|---|
| 2,166,027 | 7/1939 | Tay | 257/207 |
| 2,397,208 | 3/1946 | Saco, Jr. et al. | 257/16 |
| 2,752,128 | 6/1956 | Dedo | 257/246 |
| 2,967,225 | 1/1961 | Carrier et al. | 165/69 |
| 3,006,612 | 10/1961 | Herbert | 165/159 |
| 3,033,534 | 5/1962 | Caughill et al. | 257/235 |
| 3,185,631 | 5/1965 | Long et al. | 176/65 |
| 3,313,344 | 4/1967 | Hayden | 165/166 |
| 3,326,282 | 6/1967 | Jenssen | 165/172 |
| 3,336,974 | 8/1967 | Bernstein et al. | 165/162 |
| 3,708,142 | 1/1973 | Small | 248/49 |
| 3,809,155 | 5/1974 | Anthoney et al. | 165/133 |
| 3,967,677 | 7/1976 | Mohlman | 165/162 |
| 3,995,689 | 12/1976 | Cates | 165/166 |
| 3,999,602 | 12/1976 | Fewell et al. | 165/104 R |
| 4,119,140 | 10/1978 | Cates | 165/67 |
| 4,127,165 | 11/1978 | Small | 165/162 |
| 4,136,736 | 1/1979 | Small | 165/162 |
| 4,204,570 | 5/1980 | Einsinger | 165/69 |
| 4,284,133 | 8/1981 | Gianni et al. | 165/133 |
| 4,289,198 | 9/1981 | Young | 165/159 |
| 4,311,187 | 1/1982 | Small | 165/109 R |
| 4,386,456 | 6/1983 | Volz | 165/162 |
| 4,436,145 | 3/1984 | Manfredo et al. | 165/162 |

FOREIGN PATENT DOCUMENTS

| | | | |
|---|---|---|---|
| 0052981 | 3/1942 | Netherlands | 165/160 |

OTHER PUBLICATIONS

"Chem. Eng." Aug. 27, 1979, pp. 41, 42.

*Primary Examiner*—Albert W. Davis, Jr.
*Attorney, Agent, or Firm*—Williams, Phillips & Umphlett

[57] ABSTRACT

The tubes in a tube bundle which is laid out in an alternating array of tubes and empty lanes are supported by corrugated slats positioned in the empty lanes, separating adjacent rows of tubes, the corrugations of each of the slats extending along the length or circumference of the slat to support the tubes and generate turbulence.

11 Claims, 4 Drawing Sheets

TUBE SUPPORTS

This invention relates to heat exchangers. In one aspect, the invention relates to supporting the tubes in a shell and tube heat exchanger. In another aspect, the invention relates to providing turbulence in the shell side of a shell and tube heat exchanger.

Although shell and tube heat exchangers are widely used in the industry and highly developed, there are certain areas in which improvement would be very desirable. One area in which gains can be made relates to tube support. Structure which supports the tubes reliably is very desirable because it renders low the risk of bundle failure in the heat exchanger. Support structure which generates turbulence without excessive pressure drop is very desirable since turbulence promotes heat exchange and provides enhanced heat transfer duty for a given size bundle. Support structure which shelters only a small portion of the tube area from rapid flow of shell side fluid is very desirable because a higher fraction of the bundle is exposed to shell side fluid and available for good heat transfer increasing the heat duty for a given size bundle.

OBJECTS OF THE INVENTION

It is an object of this invention to provide a baffle for a shell and tube heat exchanger which reliably supports the tubes and generates turbulence.

It is a further object of this invention to provide a tube bundle for use in a shell and tube heat exchanger in which the tubes are reliably prevented from being damaged by vibrations and a large portion of the tubes are available for efficient heat transfer.

It is yet another object of this invention to provide a method for supporting the tubes in a shell and tube heat exchanger.

STATEMENT OF THE INVENTION

According to one aspect of the present invention, there is provided a method for supporting the tubes of the tube bundle in which the tubes are laid out at a tube sheet in an alternating array of tubes and empty lanes. The method comprises positioning corrugated slats in the empty lanes to separate the adjacent rows of the tubes with the slats. The slats are positioned between the rows so that the corrugation, meaning the ridges and valleys, of each of the slats extends lengthwise or circumferentially along the slat and has sufficient depth to provide the slat with sufficient apparent thickness so that it will contact the tubes on each side of the lane in which it has been positioned.

In another aspect of the present invention, there is provided a baffle for shell and tube heat exchanger which comprises a ring defined with respect to a center and a longitudinal axis which passes through the center which is normal to the plane of the ring. A plurality of parallel slats are attached to the ring. Each of the slats has length, a width, and a thickness. The length of each slat is measured between its attachments to the ring. The width of each slat is parallel to the longitudinal axis of the ring. The thickness of each slat is measured in a direction orthogonal to the length and the width of the slat. Each of the slats is characterized by one or more corrugations which extends along its length and is formed from a material which provides the slat with resilience so that the slat biases against compressive forces squeezing its thickness.

According to a further aspect of the present invention, a tube bundle is provided comprising a plurality of parallel tubes arranged in the form of a tube bundle. The tube bundle has a first plurality of parallel tube rows with lanes between adjacent rows and a second plurality of parallel tube rows with lanes between adjacent rows. Support structure for supporting the tubes is also provided which comprises at least a first baffle and a second baffle. Each of the first baffle and the second baffle comprises an outer ring surrounding the tube bundle and a plurality of parallel slats attached to the outer ring as chords. The slats extend through the tube bundle in at least a portion of the lanes between the adjacent tube rows in one of the pluralities of parallel tube rows. The slats have corrugations or folds, also meaning the ridges and valleys, which extends along their length for point contact with the tubes of the bundle. The slats in the first baffle extend in lanes between the first plurality of parallel tube rows. The slats in the second baffle extend in lanes between the second plurality of parallel tube rows.

According to a still further aspect of the present invention, there is provided a tube bundle having a longitudinal axis, a first end and a second end which is comprised of a plurality of parallel tubes attached to a tube sheet at the first end of the tube bundle. The tubes extend generally normally from the face of the tube sheet. The plurality of parallel tubes is arranged in a generally concentrically ringed array at the tube sheet with the longitudinal axis of the tube bundle coinciding with the center of the array. The tubes in any two adjacent rings of the array are separated by at least one corrugated tubular member positioned in the tube bundle.

DETAILED DESCRIPTION OF THE INVENTION

Figure 8:
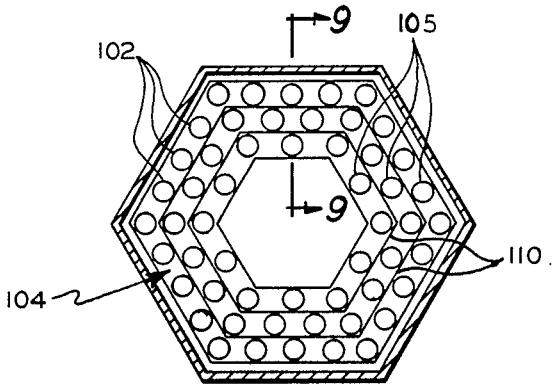
FIG. 8 is a cross-sectional representation of a tube bundle employing a plurality of tube support elements as illustrated in FIG. 7.

With reference to FIGS. 2 through 5 and 8, the tubes 2 and 102 of a tube bundle 4 and 104 are laid out in a alternating array of tubes and empty lanes. In the bundle illustrated by FIGS. 2 through 5, the tube bundle is arranged into a first plurality of parallel tube rows 6 and a second plurality of parallel tube rows 8 with lanes between the adjacent rows. In FIG. 8, the plurality of tubes 102 is arranged into a generally concentrically ringed array with the tubes in individual rings 105 of the array being separated by lanes. The rows of tubes are in the form of rings 105 as shown by FIG. 8, which can be circles or polygons, for convenience.

In accordance with the invention, adjacent rows of tubes are separated by a corrugated support member which is positioned in the tube bundle. In FIGS. 2 through 5, the corrugated support member is in the form of a slat 10 which is positioned through the tube bundle in at least a portion of the lanes between adjacent tube rows in one of the pluralities of parallel tube rows 6 or 8. In the embodiment of the invention best illustrated by FIG. 8, the tubes in any two adjacent rings 105 of the array are separated by a corrugated tubular member 110 which is positioned in the tube bundle. The corrugations extend lengthwise or circumferentially through the lane and have a sufficient depth so that the corrugated support member contacts the tubes 2 or 102 on each side of the lane in which it has been positioned.

Figure 1:
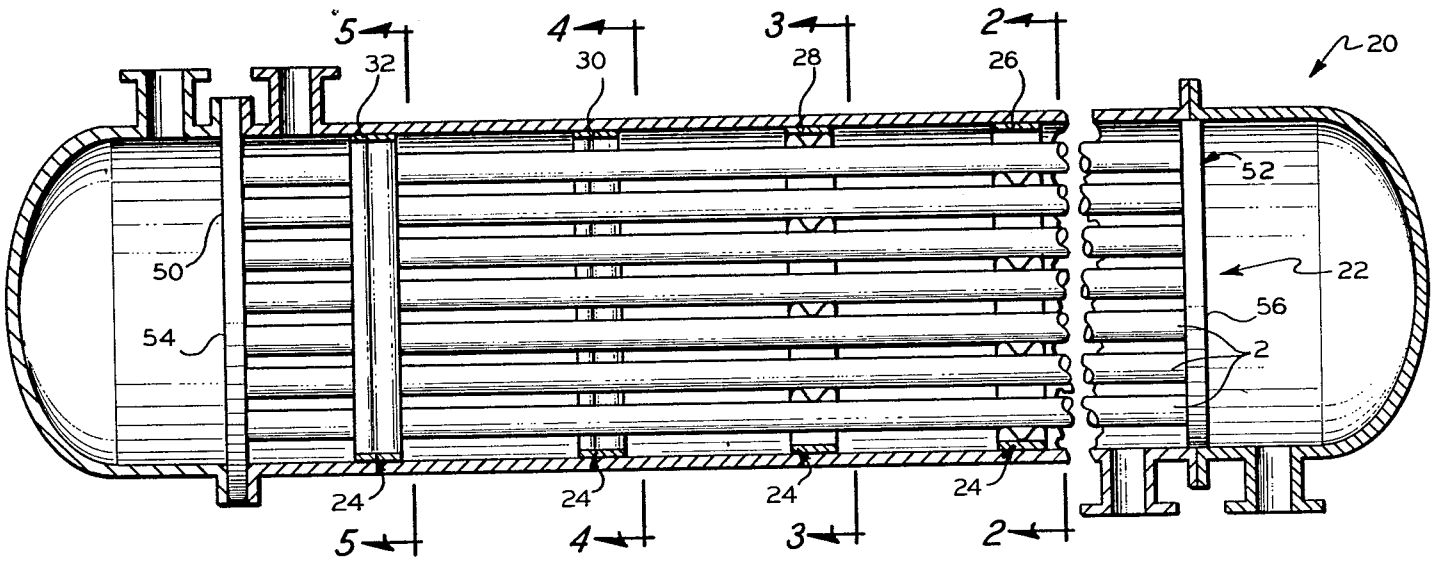
FIG. 1 is a side sectional representation of a heat exchanger which embodies certain features of one embodiment of the present invention.
Figure 5:
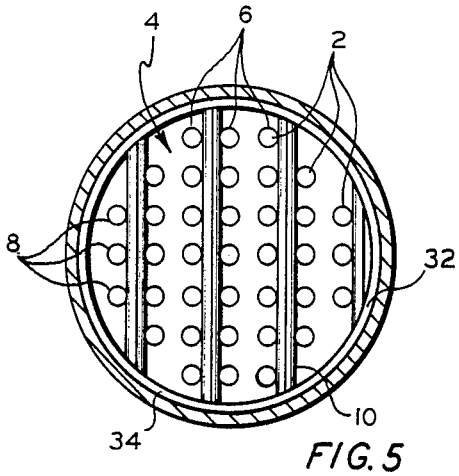
FIG. 5 is a cross-sectional view of the apparatus of FIG. 1 taken along the lines 5—5.
Figure 4:
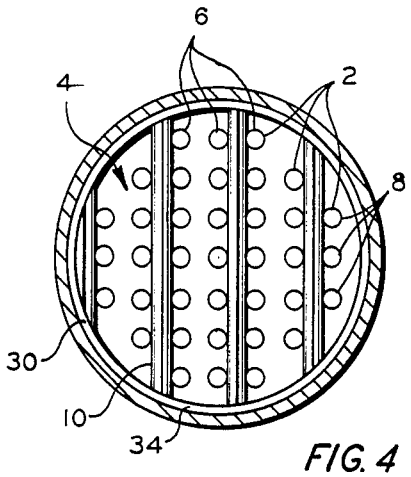
FIG. 4 is a cross-sectional view of the apparatus of FIG. 1 taken along the lines 4—4.
Figure 2:
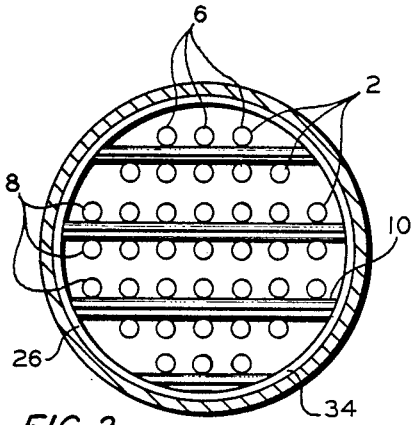
FIG. 2 is a cross-sectional view of the apparatus of FIG. 1 taken along the lines 2—2.
Figure 3:
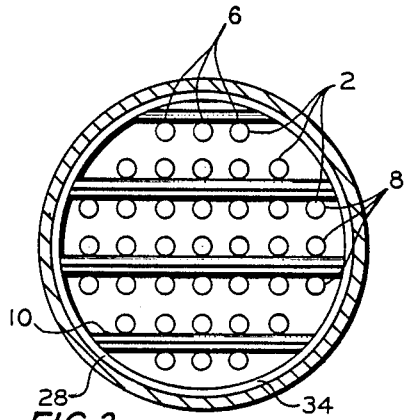
FIG. 3 is a cross-sectional view of the apparatus shown in FIG. 1 taken along the lines 3—3.
Figure 6:
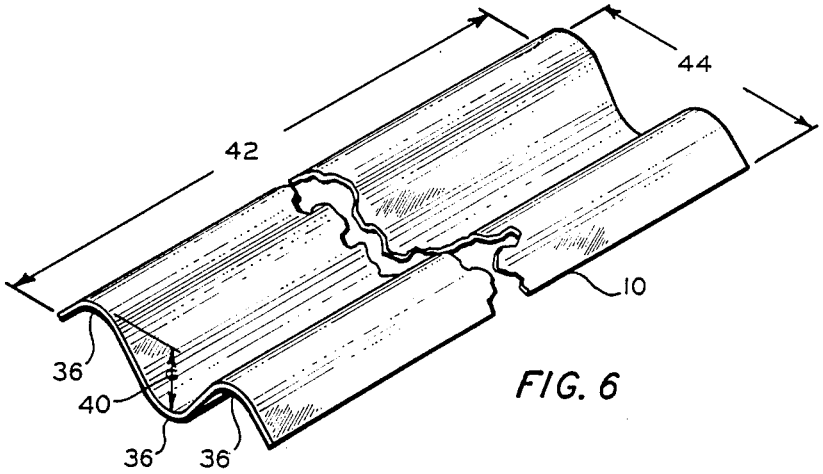
FIG. 6 is a pictorial representation of a portion of the apparatus illustrated in FIGS. 1 through 5.

Referring now to FIGS. 1 through 6, there is provided in accordance with certain aspects of the present invention, an apparatus 20 which can be a shell and tube heat exchanger. The apparatus 20 is comprised of a plurality of parallel tubes 2 arranged in the form of a tube bundle 22 having a first plurality of parallel tube rows 6 with lanes between adjacent rows and a second plurality of parallel tube rows 8 with lanes between adjacent rows. Support structure illustrated generally by the reference numeral 24 supports the tubes and prevents their being damaged by vibrations. In accordance with the embodiments of the invention illustrated, the support structure comprises at least one first baffle 26 and 28 and at least one second baffle 30 and 32 wherein each baffle 26, 28, 30 and 32 comprises an outer ring 34 surrounding the tube bundle 22 and a plurality of the slats 10 attached to the outer ring 34 as parallel chords and extending through the tube bundle 22 in at least a portion of the lanes between adjacent rows in one of said pluralities 6 or 8 of parallel tube rows. The slats 10 are characterized by corrugations 36 such as ridges and valleys as shown in FIG. 6 or folds which extend along their length 42 so as to provide point contact with the tubes 2 of the tube bundle 22. The slats 10 in each of the first baffles 26 and 28 extend in lanes between the first plurality of parallel tube rows 6 and the slats 10 in the second baffles 30 and 32 extend in lanes between the second plurality 8 of parallel tube rows.

It is preferred in this embodiment of the invention that the bundle of tubes be laid out in square pitch as is readily apparent from inspection of FIGS. 2 through 5. It is further preferable in accordance with this embodiment of the invention that the slats of any one baffle 26, 28, 30 or 32 extend through only portion of the lanes in one of the pluralities of parallel tube rows or 8. In order to provide each tube of the tube bundle 22 with radial support it is necessary to provide the bundle 22 with sufficient first baffles 26 and 28 so that at least one slat 10 is positioned in each lane between the first plurality of parallel tube rows 6 and in each lane between the second plurality of parallel tube rows 8. The depth of the corrugations or folds illustrated by reference numeral 40 in FIG. 6 is preferably sufficiently great to that the slat 10 contacts the adjacent parallel tube rows on each side of a lane through which it has been positioned. Where the slat has been formed from a material which will impart resilience to it, such as spring steel, it will press against adjacent rows of tubes against which it has been positioned to support them with a high degree of reliability.

According to certain other aspects of the present invention, there are provided baffles suitable for positioning in a tube bundle for supporting the tubes therein. Each baffle comprises a ring 34 defined with respect to a center and a longitudinal axis which passes through the center and is normal to the plane of the ring and a plurality of parallel slats 10 each having a length 42, a width 44 and a thickness 40 attached to each ring 34 as a plurality of parallel chords. The length 42 of each slat is measured between its attachments to the ring 34. The width 44 of each slat is measured in a direction parallel to the longitudinal axis of the ring 34. The thickness 40 of each slat is measured orthogonal to the length 42 and the width 44 and is greater than the thickness of the material forming the slat. Each of the slats 10 is characterized by one or more corrugations when measured along its width 44 the corrugations extending along the length of the slat, and is formed of a suitable material so that it biases against compressive forces squeezing its thickness. When this baffle is deployed in a heat exchange apparatus in accordance with the invention, the resilient thickness of the slats allows for tube diameter expansion without causing permanent damage to either the tubes or the slats. The corrugations prevent laminar flow of shell side fluid and promote heat exchange throughout the apparatus. Preferably, the corrugations of different slats at the same longitudinal position in the bundle are synchronized to avoid unnecessary restriction to flow. Flow restrictions can be further reduced by perforating the slats if desired. Preferably, the corrugations are defined by alternating ridges and valleys extending along the length 42 of the slat, the heights of the ridges and the depths of the valleys being greater than the thickness of the material forming the slat 10.

Figure 7:
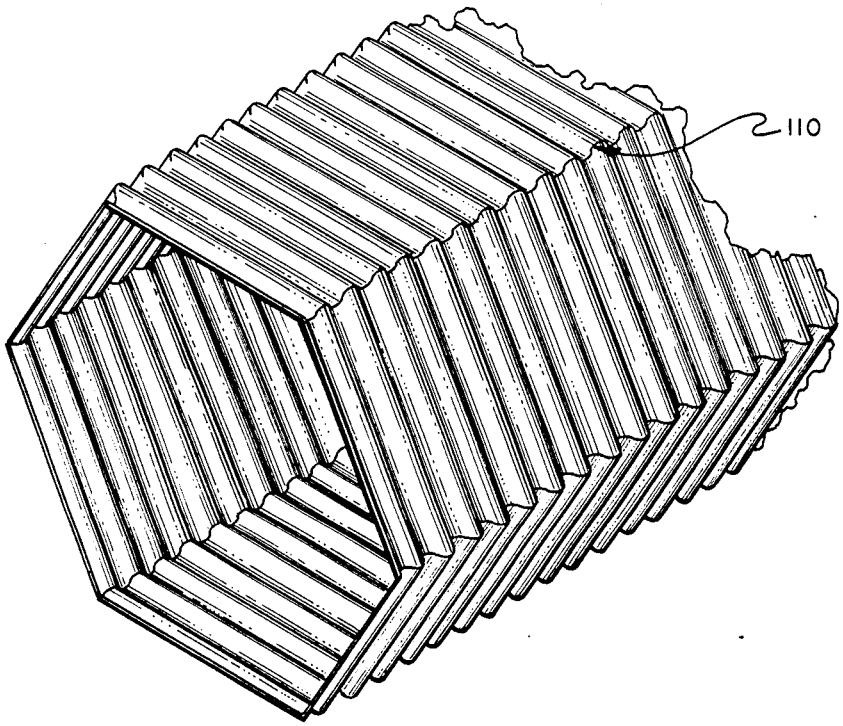
FIG. 7 is a pictorial representation of a tube support element according to certain other aspects of the present invention.
Figure 9:
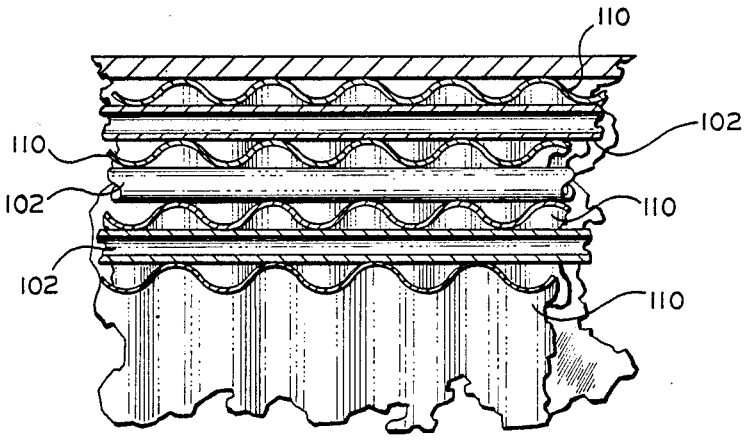
FIG. 9 is a cross-sectional representation of a tube bundle as shown in FIG. 8 taken along the lines 9—9.

In accordance with certain other aspects of the present invention, a tube bundle has a longitudinal axis, a first end 50, a second end 52 and is comprised of a plurality of parallel tubes attached to a tube sheet 54 at the first end of the tube bundle 22 and extending generally normally from the face of the tube sheet 54. As shown best by FIG. 8 the plurality of parallel tubes 102 in FIG. 8 can be arranged in a generally concentrically ringed array at the tube sheet with a longitudinal axis of the tube bundle coinciding with the center of the array. The tubes in two adjacent rings of the array are separated by a corrugated tubular member such as tubular member 110 as shown best in FIG. 7 which is positioned in the tube bundle. Preferably, a plurality of the corrugated tubular members 110 each having a longitudinal axis are concentrically positioned in the tube bundle to separate each ring 105 of the array of parallel tubes 102 from the tubes forming the adjacent ring of the array, each of said corrugated tubular members 110 being positioned so that the longitudinal axis of the corrugated tubular member 110 coincides with the longitudinal axis of the tube bundle adjacent corrugated tubular members be preferably synchronized to avoid unnecessary flow restrictions. The corrugations of the tubular member 110 extend along the lanes through which the corrugated tubular member 110 is positioned. In the embodiment of the invention illustrated in FIGS. 7 through 9, the ridges and the valleys extend generally circumferentially around the corrugated tubular member. As shown best by FIG. 9 the ridges and valleys are of sufficient height and depth so that the spacing between adjacent rings or rows of tubes in the array is traversed by the corrugated tubular member and the tubes in the adjacent rings of the array are contacted and supported by the corrugated tubular members 110. As further shown in FIG. 1, the tube bundle can comprise a second tube sheet 56 attached to the second end 52 of the tube bundle. A plurality of corrugated tubular members 110 can then be spaced apart in the tube bundle between the first end and the second end of the tube bundle with at least one corrugated tubular member 110 positioned between each ring 105 of the array of tubes 102 forming the bundle.

It will be appreciated that the tube bundle can be arranged in an array of concentric circles or polygons. Where the polygons are square, the embodiment of the invention illustrated in FIGS. 1 through 6 will be preferred, since the tubes will be arranged into a first plurality of parallel tube rows with the lanes between the rows and a second plurality of parallel tube rows with lanes between the rows. In either event, it is preferable that the slats be positioned in a plane which is generally normal to the longitudinal axis of the tube bundle for ease of construction. Where the tube bundle is laid out in square pitch, it is additionally preferred that the slats be attached to a ring which encircles the tube bundle.

While there have been illustrated and described certain preferred embodiments of the present invention, it is not to be construed as so limited except to the extent that such limitations are found in the claims.

What is claimed is:

1. Apparatus comprising a ring defined with respect to a center and a longitudinal axis which passes through the center and is normal to the plane of the ring, and at least one slat having a length, a width and a thickness attached to said ring as a chord, the length of the slat being measured between its attachments to the ring, the width of the slat being measured parallel to the longitudinal axis of the ring, and the thickness of the slat being measured orthogonal to the length and the width of the slat, said slat being characterized by one or more corrugations extending along its length and being formed of a suitable material so that it biases against compressive forces squeezing its thickness.

2. Apparatus as in claim 1 comprising a plurality of parallel slats attached to the ring as parallel chords, wherein the corrugations are defined by alternating ridges and valleys extending along the length of the slat, the thickness of the slat being greater than the thickness of the material forming the slat.

3. Apparatus comprising a plurality of parallel tubes arranged in the form of a tube bundle having a first plurality of parallel tube rows with lanes between adjacent rows and a second plurality of parallel tube rows with lanes between adjacent rows and support structure for supporting the tubes, said support structure comprising at least a first baffle and a second baffle wherein each baffle comprises an outer ring surrounding the tube bundle and at least one slat attached to the outer ring as a chord and extending through the tube bundle between adjacent row sin one of said pluralities of parallel tube rows, said at least one slat being characterized by corrugations or folds extending along its length for point contact with the tubes of the bundle, the at least one slat in the first baffle extending in lanes between the first plurality of parallel tube rows, the at least one slat in the second baffle extending in lanes between the second plurality of parallel tube rows.

4. An apparatus as in claim 3 wherein the bundle of tubes is laid out in square pitch and a plurality of parallel slats are attached to the outer ring as chords.

5. An apparatus as in claim 4 wherein the slats of any one baffle extend through only a portion of the lanes in one of the pluralities of parallel tube rows, the tube bundle being provided with sufficient first baffles and second baffles so that at least one slat is positioned in each lane between the first plurality of parallel tube rows and in each lane between the second plurality of parallel tube rows to provide the tubes with radial support.

6. An apparatus as in claim 5 wherein the depth of the corrugations or folds in each slat is sufficiently great so the slat contacts the adjacent parallel tube rows on each side of the lane through which it is positioned.

7. A method for supporting the tubes of a tube bundle having a longitudinal axis and suitable for positioning in a shell to form a shell and tube heat exchanger in which shell side fluid flows along the longitudinal axis of the tube bundle and the tubes are laid out at the tube sheet in an alternating array of tubes and empty lanes comprising positioning corrugated members in the empty lanes to separate the adjacent rows of tubes with corrugated members, the corrugations of each corrugated member extending lengthwise or circumferentially along the corrugated member and being of sufficient depth so that the member contacts the tubes on each side of the lane in which it has been positioned.

8. A method as in claim 7 in which the tubes are parallel to each other and are arranged in an array of concentric polygons.

9. A method as in claim 7 in which the tubes are parallel to each other and are arranged into a first plurality of parallel tube rows with lanes between the rows and a second plurality of parallel tube rows with lanes between the rows.

10. A method as in claim 7 wherein the corrugated members comprise slats which are positioned in a plane which is generally normal to the longitudinal axis of the tube bundle.

11. A method as in claim 9 wherein the slats lie in a plane generally normal to the longitudinal axis of the tube bundle and are attached to a ring which encircles the tube bundle.

* * * * *